United States Patent [19]

Yamamoto et al.

[11] Patent Number: 4,661,690

[45] Date of Patent: Apr. 28, 1987

[54] PTC HEATING WIRE

[75] Inventors: Shuji Yamamoto, Nara; Yoshio Kishimoto, Osaka; Seishi Terakado, Nara; Hideho Shinoda, Yamatokoriyama, all of Japan

[73] Assignee: Matsushita Electric Industrial Co., Ltd., Japan

[21] Appl. No.: 752,043

[22] PCT Filed: Oct. 19, 1984

[86] PCT No.: PCT/JP84/00500

§ 371 Date: Jun. 21, 1985

§ 102(e) Date: Jun. 21, 1985

[87] PCT Pub. No.: WO85/02086

PCT Pub. Date: May 9, 1985

[30] Foreign Application Priority Data

Oct. 24, 1983 [JP] Japan ..... 58-198530

[51] Int. Cl.[4] ..... H05B 3/34

[52] U.S. Cl. ..... 219/549; 219/553; 219/505

[58] Field of Search ..... 219/211, 212, 505, 504, 219/528, 541, 544, 548, 549, 553; 338/22 R, 22 SD, 214; 174/106 SC, 107, 120 SC; 264/105, 174; 252/518

[56] References Cited

U.S. PATENT DOCUMENTS

| | | | |
|---|---|---|---|
| 2,846,560 | 8/1958 | Jacoby et al. | 219/528 X |
| 2,848,559 | 8/1958 | Rosenberg | 219/528 X |
| 3,410,984 | 11/1968 | Sandford et al. | 219/212 |
| 4,271,350 | 6/1981 | Crowley | 219/549 |
| 4,436,986 | 3/1984 | Carlson | 219/505 |
| 4,503,322 | 3/1985 | Kishimoto et al. | 219/505 |
| 4,517,449 | 5/1985 | Chazan et al. | 219/549 |

FOREIGN PATENT DOCUMENTS

| | | |
|---|---|---|
| 2416611 | 8/1979 | France . |
| 2075777 | 11/1981 | United Kingdom . |
| 2079569 | 1/1982 | United Kingdom . |

*Primary Examiner*—E. A. Goldberg
*Assistant Examiner*—M. M. Lateef
*Attorney, Agent, or Firm*—Lowe, Price, Leblanc, Becker & Shur

[57] ABSTRACT

This invention provides a PTC heating wire (12), (13) of a tubular or band form which comprises a pair of electrodes (2), (2'), a PTC resistor (3) provided between the electrodes, and an insulative sheath (4) covering the electrodes and resistor, in which a numerical formula for setting a resistance, $R_E$, within a tolerance range including an optimum resistance value is first determined. In practice, the resistance, $R_E$, of the electrodes (2), (2') is properly determined, according to use conditions, using the numerical formula, thereby obtaining a PTC heating wire which ensures safe service.

13 Claims, 10 Drawing Figures

PTC HEATING WIRE

TECHNICAL FIELD

This invention relates to PTC (positive temperature coefficient) heating wires useful as heating appliances and ordinary heating apparatus and provides PTC heating wires of high quality in which an appropriate electrode resistance is set according to use conditions in order to assure safe service.

BACKGROUND TECHNIQUES

Conventional PTC heating wires are arranged as shown in FIGS. 1 and 2. The wire of FIG. 1 has cores 1, 1' and metallic foil electrodes 2,2' spirally wound, rspectively, about the cores, which are entirely covered with a PTC resistor 3 and an insulative sheath 4 in this order. The wire of FIG. 2 includes a core 1, which is covered, as shown, with an electrode 2, a PTC resistor 3, an electrode 2' and an insulative sheath 4 in this order. When these PTC heating wires are energized by application of a voltage between the electrodes 2 and 2', the electrodes 2,2' as well as the PTC resistor 3 generate heat. The amount of heat generated from the electrodes 2,2' depends chiefly on the electrode resistance and the electric current, and the heat generated in the electrode is greater at a portion which is nearer to the voltage-applied point. This is considered for the reason that the electric current passing through the electrodes 2,2' is greater at a portion nearer to the voltage-applied point because of the leakage current from the electrodes 2,2' to the PTC resistor. This leads to the fact that when the resistance of the electrode per unit length is high, the leakage current to the PTC resistor 3 becomes great with a wide distribution of the heat in the electrode. FIG. 3 is a schematic view of wire connections which enable the drop of voltage by the electrode resistance to be minimized and also the non-uniformity of generated heat along the heating wire to be minimized. As shown in the figure, a voltage is applied between one end of the electrode 2 and the other end of the other electrode 2'. In these wire connections, when the ratio of the electrode resistance to the PTC resistance is high, the distribution of a generated heat density becomes great. The electric circuit of the PTC heating wire using the wire connections will be shown in FIG. 4. The PTC heating wire involves a "ladder-type circuit" of the resistances of the electrodes 2, 2' and the resistance of the PTC resistor 3. Assuming that the heating wire is cut to unit length, a resistance of unit length of one electrode is represented by $R_E$ and a volume specific resistance under stable conditions of the PTC resistor per unit length is represented by $R_{PTC}$. L means a unit conduction path length of the PTC heating wire. In the model circuit of FIG. 4, the density distribution becomes greater at a higher value of $R_E$. If the distribution is too wide, such PTC heating wire cannot stand practical use.

Moreover, if the electrode resistance is high, the heat generated in the electrode becomes great, presenting the safety problem. In particular, when a continuous PTC heating wire is applied as electric articles of high electric capacity, the electrodes 2, 2' reach high temperatures under abnormal, heat-insulated conditions because of the absence of self-temperature control function and thus the heating wire cannot be safe.

In order to solve the problem, it is necessary to reduce the electrode resistance. However, if the electrode resistance is reduced limitlessly, other two problems may take place depending on the conditions for use. One of the problems is that for better electric conductivity, the electrodes 2,2' must have a larger size with a difficulty for mounting. The larger size of the electrodes 2,2' involves not only the difficulty for their mounting, but also the very high possibility of damaging the PTC resistor 3 on bending and breaking the electrodes 2,2' per se.

Another problem may be left even after removal of the limitation on the mounting as described below.

If the electrode resistance is made small, the drop of voltage caused by the electrodes 2,2' becomes small with a small distribution of generated heat. This makes a small amount of heat generated in the electrodes, so that most of heat generated in the PTC heating wire is attributed to the heat from the PTC resistor 3. The electric current passing through the PTC heating wire depends largely on the resistance of the PTC resistor 3 and thus the ratio of a rush current at the time of commencement of energization and a current at the time of stable energization (hereinafter referred to simply as rush current ratio) is dependent fully on the PTC characteristic. If the rush current at the time of commencement of energization is permitted to pass through the PTC heating wire of a continuous form in amounts two or more times the current under stable conditions, abnormality is apt to occur locally, leading to a serious safety problem of breakage or burning of the PTC heating wire. For instance, when the PTC heating wire is applied to ordinary domestic heating appliances and the PTC characteristic of the PTC resistor 3 is such that the temperature coefficient at 70° C. is about 3 times higher than at 20° C. with respect to resistance as particularly shown in FIG. 5, the rush current at 20° C. will exceed 2000 W provided that the electric power under stable conditions is 700 W. In addition, the distribution of heat generation is very wide. To avoid this, it may occur to one that a PTC resistor, which has a smaller temperature coefficient than the temperature coefficient of the PTC resistor shown in FIG. 5, is used. However, this is disadvantageous in that the self-temperature control function of the PTC heating wire is weakened, thus laking stabilities against variations of voltage, room temperature and load. In this sense, the use of such PTC resistor is not appropriate for fabrication of a heating wire utilizing the PTC characteristic.

As will be appreciated from the above, when the electrode resistance of the PTC heating wire is too high, there are involved several problems that the distribution of heat generation is so great that the heating wire cannot stand practical use and that the heating wire becomes hot under abnormal heat-insulated conditions, so that the safe service of the wire is not ensured. On the other hand, when the electrode resistance is too small, the afore-described mounting and safety problems are produced.

DISCLOSURE OF THE INVENTION

This invention relates to PTC heating wires useful as heating appliances and ordinary heating apparatus and provides PTC heating wires in which the distribution of generated heat, the rush current ratio and the safety margin under abnormal heat-insulated conditions of PTC heating wires are determined in relation to the electrode resistance whereby there are obtained PTC heating wires of high quality which involve no safety problem.

The present invention contemplates to provide a PTC heating element of a tubular or band form which comprises a pair of electrodes facing each other, a PTC resistor provided between the paired electrodes and having a positive resistance temperature coefficient, and an insulative sheath for covering the paired electrodes and the resistor. In the PTC heating element, when a resistance of the electrodes per unit length is taken as $R_E$ [ohms/m], a unit conduction path length of the PTC heating element is taken as L [m], and a PTC characteristic of the PTC resistor is expressed as a ratio, $R_{70}/R_{20}$, in which $R_{70}$ represents a resistance at 70° C. and $R_{20}$ represents a resistance at 20° C., $R_E$ should be a value satisfying the following relationship at arbitrary values of $R_{70}/R_{20}$ and L $$1.44 - \frac{0.1}{\log(R_{70}/R_{20}) - 0.20} \leqq \log(L \times R_E)$$

One embodiment of the invention is described with reference to the accompanying drawings.

BEST MODE FOR CARRYING OUT THE INVENTION

Figure 1:
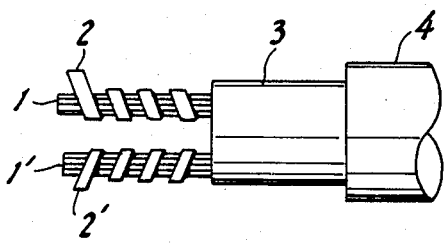
FIG. 1 is a schematic view of a PTC heating wire according to one embodiment of the invention.
Figure 2:
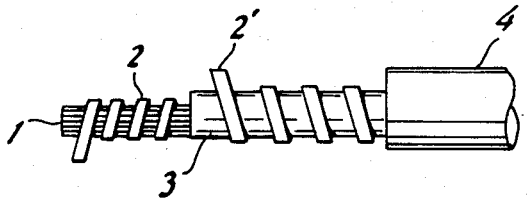
FIG. 2 is a schematic view of a PTC heating wire according to another embodiment of the invention.
Figure 3:
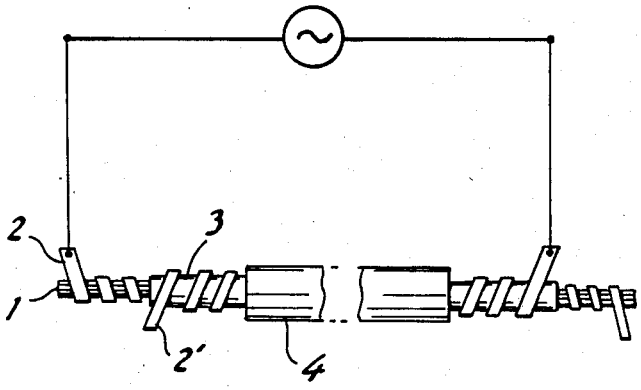
FIG. 3 is a view showing terminal connections of a PTC heating wire according to one embodiment of the invention.
Figure 4:
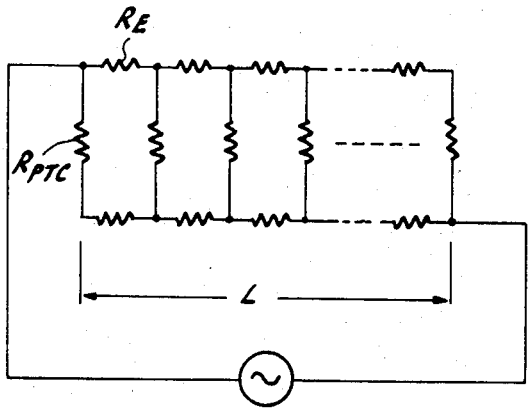
FIG. 4 is a model circuit diagram of the PTC heating wire according to one embodiment of the invention.
Figure 6:
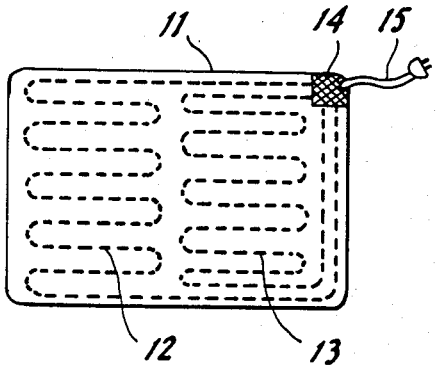
FIG. 6 is a schematic view of an article using the PTC heating wire according to one embodiment of the invention.
Figure 7:
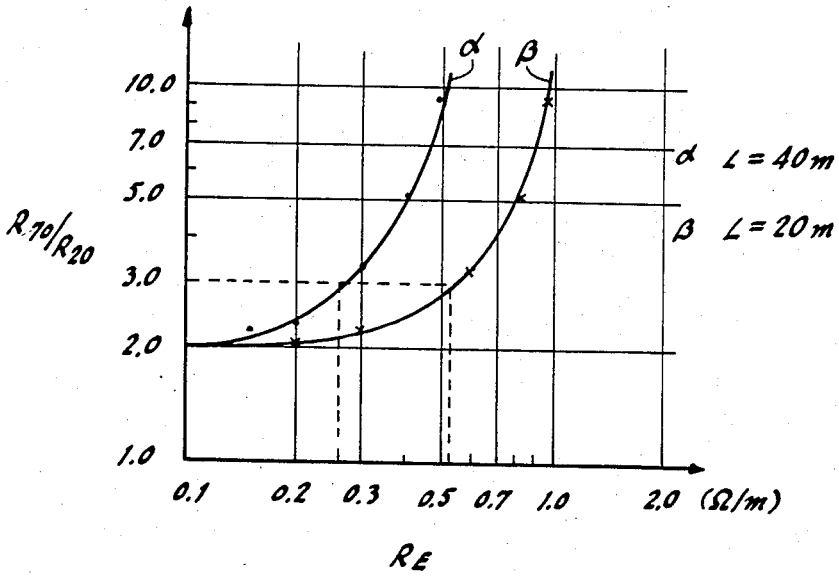
FIG. 7 is a characteristic curve of the PTC heating wire according to one embodiment of the invention.

Embodiments of the invention are as shown in FIGS. 1 and 2 and fundamentally comprise cores 1,1', electrodes 2,2', a PTC resistor 3 provided between the electrodes 2,2', and an outer sheath 4. A heating appliance using these PTC heating wires may be an electric carpet as shown in FIG. 6. In FIG. 6, a carpet body 11 includes PTC heating wires 12, 13, each arranged in zigzag form, and a cord distributor 14 provided at one corner of the body 11 through which the PTC heating wires 12, 13 and a power cord 15 are connected. The PTC heating wires 12, 13 and the power cord are connected such that a supply voltage is applied between one end of the electrode 2 and the other end of the other electrode 2' as shown in FIG. 3. As described before, this manner of connection is effective in minimizing the degree of non-uniformity of heat generated at different portions of the heating wire as will be caused by the leakage current to the PTC resistor 3. The PTC heating wires 12,13 may be expressed by the circuit pattern shown in FIG. 4.

Where the PTC heating wires 12, 13 are employed in the electric carpet shown in FIG. 6, the ratio of a current at the time of commencement of energization of the electric carpet and a current at the time of stable energization (i.e. the rush current ratio) is considered to have close relation to the PTC characteristic and also to the length of the PTC heating wires 12, 13 as expressed by the unit conduction path length and the electrode resistance. We experimentally found that the PTC characteristic, length of the heating wire and electrode resistance were interrelated with one another in order to decrease the rush current ratio. The experimental results are shown in FIG. 7. A number of PTC heating wires were made using various combinations of electrodes which had a unit conduction path length of 40 m and different resistances, $R_E$, and PTC resistors 12, 13 having different PTC resistances and PTC characteristics (i.e. ratio, $R_{70}/R_{20}$ in which $R_{70}$ represents a resistance at 70° C. and $R_{20}$ represents a resistance at 20° C.). These wires were built in for use as electric carpets and subjected to an energization test. The relation between $R_{70}/R_{20}$ and $R_E$ for the rush current ratio of 2 is plotted as "•" in curve ($\alpha$) of FIG. 7. Likewise, PTC heating wires having a unit conduction path length of 20 m and various combinations of electrode resistances and PTC characteristics were made and subjected to the energization test. The values which had a rush current ratio of 2 are plotted as "x" in curve ($\beta$) of the figure. Based on these results, the following relationship using $R_{70}/R_{20}$, $R_E$ and L was deduced.

$$1.44 - \frac{0.1}{\log(R_{70}/R_{20}) - 0.20} = \log(L \times R_E)$$

The above relationship is well coincident with the experimental results of FIG. 7, thus succeeding in generalization. Because the rush current ratio should be not greater than 2, the above relationship should be $$1.44 - \frac{0.1}{\log(R_{70}/R_{20}) - 0.20} \leqq \log(L \times R_E)$$

When the above relationship is used in which the PTC resistor is made, for example, of a material having a PTC characteristic, $R_{70}/R_{20}$, of 3.0 and the length of the PTC heating wire is 42 m, the lower limit of the electrode resistance required for the rush current ratio of not greater than 2 is 0.29 [ohm/m].

Figure 5:
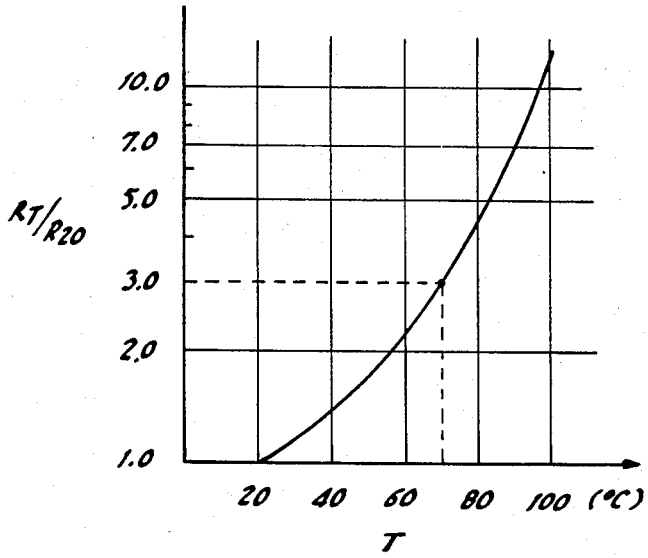
FIG. 5 is a characteristic curve of the PTC heating wire according to one embodiment of the invention.
Figure 8:
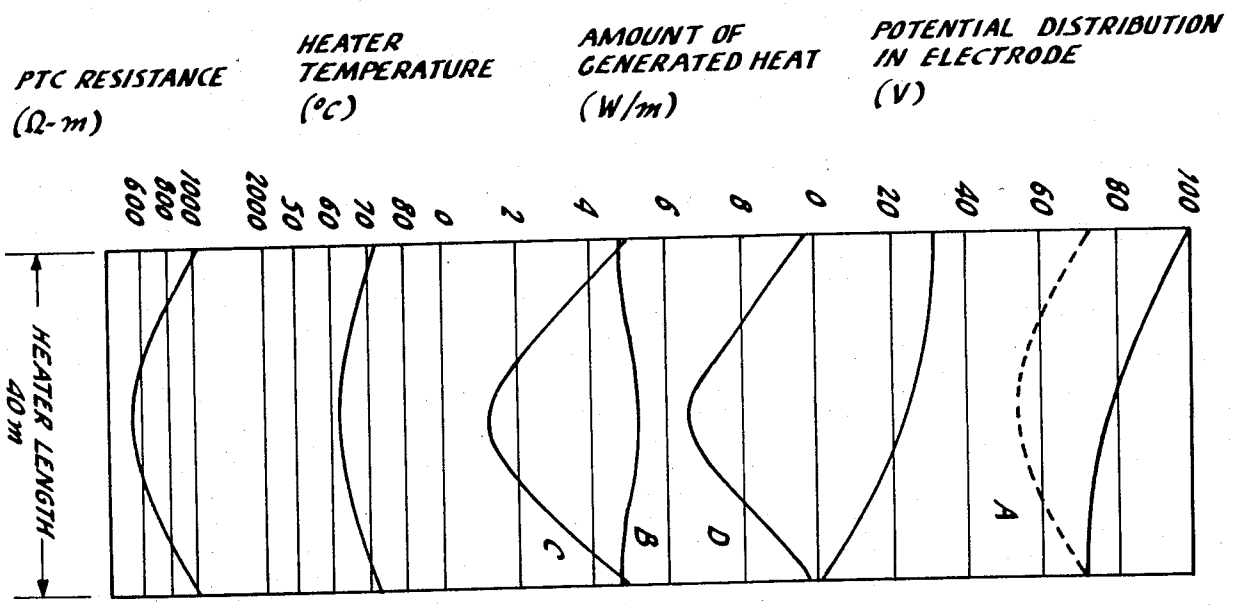
FIG. 8 is a graphical representation of a potential distribution within electrode, a distribution of heat generation, a temperature distribution and a PTC resistance distribution of a conventional heating wire.

On the other hand, a PTC heating wire having a high electrode resistance value ($R_E$=1.6–2.0 ohms/m) was assembled as an electric carpet as shown in FIG. 6, and was subjected to a heating test. It was found that the surface temperature greatly differed between peripheral and central portions, so that it was inconvenient to use such carpet since the temperature of the carpet changed with location. This is considered due to the fact that the heat generation density of the PTC heating wire greatly differs between the end and central portions of the wire. In other words, the difference is considered to be attributed to the fact that because of the leakage current to the PTC resistor 3, the electric current passing through the electrodes 2,2' is greater at the portion where voltage is applied. To avoid this, it is necessary to reduce the electrode resistance, but it is not known how to reduce the resistance. To clarify this problem, measurements were effected in detail with respect to the potential distribution within the electrodes, heater temperature, and amount of generated heat. A PTC heating wire was made using electrodes which had a resistance per unit length of 0.4 ohm/m and such a PTC characteristic of the PTC resistor as shown in FIG. 5. This heating wire was assembled in a carpet body as shown in FIG. 6, followed by measurements of the potential distribution within electrode, heater temperature and generated heat distribution. The results are shown in FIG. 8, in which curve B indicates an amount of heat generated in the PTC heating resistor 3, curve C indicates an amount of heat generated from the electrodes 2,2', and curve D indicates the total amount of generated heat. The length of the heater was 40 (m) and an AC voltage of 100 (V) was applied to the the heating wire in the manner of connection shown in FIG. 3. More particularly, AC 100 (V) was applied between the facing electrodes 2,2' at opposite ends of the PTC heating element. The voltage drop caused by the electrode resistance becomes greater at a portion nearer to the terminal where the voltage is applied, and the voltage (indicated by broken line A in FIG. 8) applied to the PTC resistor 2 is minimized at the central portion. The amount of heat generated from the electrodes was calculated based on the results of the measurement of the potential distribution, and the resistance of the PTC resistor was determined from the results of the measurement of the temperature distribution and the PTC characteristic of FIG. 5. In addition, the amount of heat generated from the PTC resistor was determined from the voltage applied to the PTC resistor. The amount of heat generated from the electrode greatly differs between the voltage-applied portion and the central portion, and the difference of the heater temperature is about 10° C., which depends on the difference in amount of generated heat. The PTC resistance differs according to the temperature difference, i.e. the PTC resistance is lower at the central portion. However, the voltage applied to the central portion of the PTC resistor is also low, so that the amount of generated heat is not so different. In view of the above, the reason why the heater temperature is so differentiated as by about 10° C. is considered due to the distribution of the current passing through the electrodes based on the leakage current to the PTC resistor 3. To avoid this, it is sufficient to reduce the resistance of the electrodes. It is considered that the distribution of heat generated from the PTC heating wire is determined on the basis of the volume specific resistance of the PTC resistor 3 and the electrode resistance in relation to the length of the heating element.

Therefore, PTC heating wires were made using various combinations of electrode resistances, PTC resistors and lengths of the heating wire, and used for similar experiments. As a result, it was found that the ratio in amount of generated heat between the central portion and the voltage-applied portion of the heating element was dominated according to a dimensionless value of $R_E \times L^2/R_{PTC}$, in which $R_E$ represents a resistance per unit length of one electrode [ohm/m], L represents a unit conduction path length [m] of the PTC heating wire, and $R_{PTC}$ represents a volume specific resistance [ohms·m] of the PTC resistor 3 under stable conditions. The "volume specific resistance under stable conditions" means a volume specific resistance at the time when the PTC heating wire is thermally saturated after energization.

Figure 9:
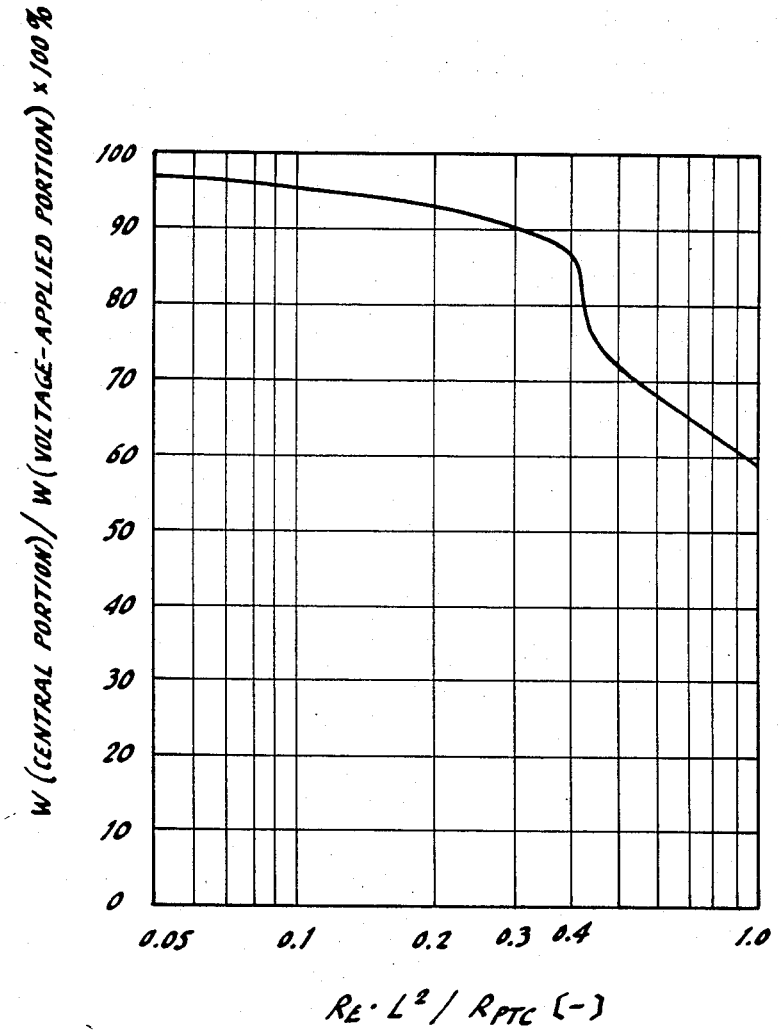
FIG. 9 is a graphical view of the relation between degree of non-uniformity of heat generation in a heating wire of the invention and $R_E \times L^2/R_{PTC}$.

The relation between the dimensionless value and the heat generation distribution is shown in FIG. 9. When the value of $R_E \cdot L^2/R_{PTC}$ exceeds about 0.4, the distribution of heat generated becomes abruptly wide. It was also found that the relation between the dimensionless value and the generated heat distribution was invariably established almost irrespective of the applied voltage, heat-insulating conditions and the PTC characteristic of the PTC resistor.

In order to make the ratio in heat generation between the central portion and the end portion of the PTC heating wire at 85% or higher, the following relation should be satisfied.

$$R_E \cdot L^2/R_{PTC} \leqq 0.4$$

In this condition, the temperature difference, on the carpet surface, between the end and central portions is below about 3° C. without involving any practical problem. When the value of $R_E \cdot L^2/R_{PTC}$ exceeds 0.4, the heat distribution becomes wide abruptly, so that the carpet cannot stand practical use.

Figure 10:
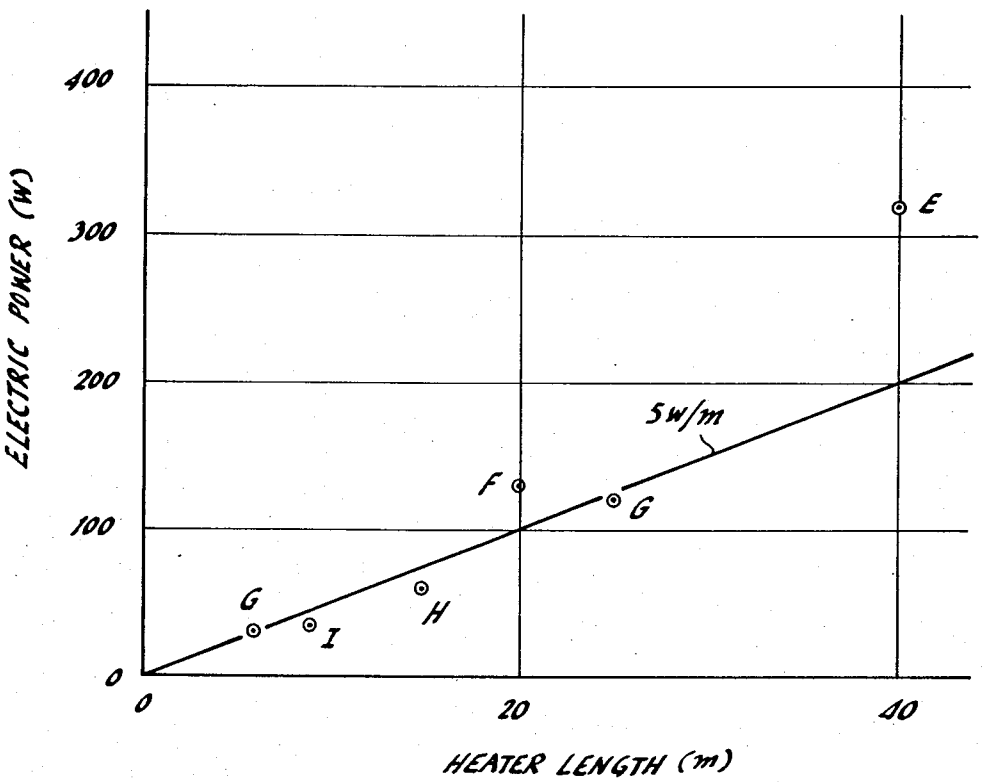
FIG. 10 is a view showing the relation between length of a heating wire in ordinary heating appliances and electric power.

Thus, since the degree of non-uniformity of heat generation is expressed by the dimensionless value which can be calculated from the electrode resistance, the length of the PTC heating wire and the volume specific resistance under stable conditions of the PTC resistor 3, an optimum electrode resistance of the PTC heating wire can be readily determined under any conditions and on use of PTC materials having different characteristics. FIG. 10 shows the relation between length of a heating wire used in typical heating apparatus and supply power. In case where the PTC heating wire of the invention is applied to these apparatus, an optimum electrode resistance can be readily determined. For instance, when the PTC heating wire is utilized in electric carpet E, the length of the heater should be about 40 (m) with supply power of about 320 W in order to attain an appropriate, uniform heating temperature. If the PTC resistor 3 having a volume specific resistance of about 1500 (ohms.m) under stable conditions is used, the electrode resistance should be below 0.375 (ohm/m). In the figure, indicated by F is a floor heater, by G is an electric blanket, by H is an electric robe, by I is an electric cushion, and by J is a foot or bed warmer.

The second problem involved in the case where the electrode resistance is great is solved as follows. The generated heat distribution becomes wide, when the electrode resistance is great, along with an increase in amount of generated heat. The electrodes 2,2' have no PTC characteristic, so that if the amount of generated heat becomes too great, there is the danger that the heating wire is elevated to too high temperatures under abnormal, heat-insulated conditions. In other words, the electrodes 2,2' have no self-temperature control function as the PTC resistor 3, so that it should be taken into consideration to restrict the amount of generated heat per unit length. This is very important when the PTC heating wire is applied to electric appliances of high electric capacity. As shown in FIG. 10, ordinary heating appliances should have an amount of heat of at least 5 (W/m) in order to make a uniform heating temperature level. When applied to an electric carpet, the heating wire should have a length of at least 40 (m).

In order to clarify the relation between the amount of heat generated in the electrodes 2,2' and the temperature of the heating element under thermally insulating conditions in case where the length is 40 (m) and the amount of generated heat is 5.0 (W/m), an experiment was conducted using electrodes having different resistances. As a result, it was found that when an applied voltage was in the range of 100–120 (V) and the electrode had a high resistance exceeding 1.0 (ohm/m), the temperature of the PTC heating element exceeded 120° C. Similarly, when the applied voltage was in the range of 200–240 (V) and the electrode resistance exceeded 4.0 (ohms/m), the temperature of the heating element exceeded 120° C. In either case, only portions near terminals where the voltage was applied reached a maximum temperature. However, when the heating element was heated to temperatures over 120° C., it was experimentally confirmed that articles using such element was not safe and reliable. Accordingly, when the PTC heating wire of the invention is employed under conditions of an applied voltage of 100–120 (V), it is necessary to set the electrode resistance at not larger than 1.0 (ohm/m). Under conditions of an applied voltage of 200–240 (V), the resistance should preferably be below 4.0 (ohms/m). In this connection, however, if the amount of heat is increased over 5 (W/m), the upper limit of the electrode resistance should be smaller than the above-indicated value and thus it is necessary to strictly determine an upper value.

In the above embodiment, the concept of the present invention is described using a method in which a voltage is applied between one end of one electrode 2 and the other end of the other electrode 2' as shown in FIG. 3. However, it is possible to apply a voltage between opposite ends of the respective electrodes 2,2' in which one end of electrode 2 is short-circuited with the other end thereof and one end of the electrode 2' is also short-circuited with the other end. In this method, the apparent unit conduction path length of the heating wire will be taken as L/2 in the practice of the invention.

POSSIBILITY OF INDUSTRIAL UTILIZATION

As described hereinabove, the range of an electrode resistance of the PTC heating wire including an optimum electrode resistance can be determined according to an equation. This allows easy design of the heating wire which is highly safe, has no troubles on assembling in electric appliances, and is easy to handle.

What is claimed is:

1. In a PTC heating wire of a tubular or band form which comprises a pair of facing electrodes, a PTC (positive temperature coefficient) resistor having a large positive resistance temperature coefficient and provided between the paired electrodes, and an insulative sheath provided about the paired electrodes and the resistor, the improvement in that when electrode resistance per unit length is taken as $R_E$ [ohm/m], a unit conduction path length of the PTC heating wire is taken as L [m] and a PTC characteristic of the PTC resistor is expressed as a ratio, $R_{70}/R_{20}$, in which $R_{70}$ represents a resistance of the PTC resistor at 70° C. and $R_{20}$ represents a resistance at 20° C., the value of $R_E$ is determined to satisfy the following relationship for arbitrary values of $R_{70}/R_{20}$ and L $$1.44 - \frac{0.1}{\log(R_{70}/R_{20}) - 0.20} \leqq \log(L \times R_E)$$

2. A PTC heating wire according to claim 1, wherein when a resistance of the electrode per unit length is taken as $R_E$ [ohm/m], a unit conduction path length of the PTC heating wire is taken as L [m] and a volume specific resistance of the PTC resistor under stable conditions is taken as $R_{PTC}$ [ohm·m], the value of $R_E$ is determined to satisfy the following relationship for arbitrary values of $R_{PTC}$ and L, $$R_E \times L^2/R_{PTC} \leqq 0.4.$$

3. A PTC heating wire according to claim 2, wherein when a resistance of the paired electrode per unit length is taken as $R_E$ [ohm/m], $R_E \leqq 1.0$ [ohm/m] in an applied voltage range of 100–120 [V] and $R_E \leqq 4.0$ [ohm/m] in an applied voltage range of 200–240 [V].

4. In a PTC heating wire of a tubular or band form which comprises a pair of facing cores, electrodes spirally wound about the respective cores, a PTC resistor provided between the electrodes and having a large positive resistance temperature coefficient, and an insulative sheath provided about the electrodes and the resistor, the improvement in that when electrode resistance per unit length is taken as $R_E$ [ohm/m], a unit conduction path length of the PTC heating wire is taken as L [m] and a PTC characteristic of the PTC resistor is expressed as a ratio, $R_{70}/R_{20}$, in which $R_{70}$ represents a resistance of the PTC resistor at 70° C. and $R_{20}$ represents a resistance at 20° C., the value of $R_E$ is determined to satisfy the following relationship for arbitrary values of $R_{70}/R_{20}$ and L $$1.44 - \frac{0.1}{\log(R_{70}/R_{20}) - 0.20} \leqq \log(L \times R_E).$$

5. A PTC heating wire according to claim 4, wherein when a resistance of the paired electrodes per unit length is taken as $R_E$ [ohm/m], a unit conduction path length of the PTC heating wire is taken as L [m] and a volume specific resistance of the PTC resistor under stable conditions is taken as $R_{PTC}$ [ohm·m], the value of $R_E$ is determined to satisfy the following relationship for arbitrary values of $R_{PTC}$ and L, $$R_E \times L^2/R_{PTC} \leqq 0.4.$$

6. A PTC heating wire according to claim 5, wherein when a resistance of the electrode per unit length is taken a $R_E$ [ohm/m], $R_E \leqq 1.0$ [ohm/m] in an applied voltage range of 100–120 [V] and $R_E \leqq 4.0$ [ohm/m] in an applied voltage range of 200–240 [V].

7. In a PTC heating wire of a tubular or band form which comprises a core, a first electrode spirally wound about the core, a PTC resistor covering the core and the first electrode and having a large positive resistance temperature coefficient, a second electrode spirally wound about the PTC resistor, and an insulative sheath provided about the second electrode, the improvement in that when electrode resistance per unit length is taken as $R_E$ [ohm/m], a unit conduction path length of the PTC heating wire is taken as L [m] and a PTC characteristic of the PTC resistor is expressed as a ratio, $R_{70}/R_{20}$, in which $R_{70}$ represents a resistance of the PTC resistor at 70° C. and $R_{20}$ represents a resistance at 20° C., the value of $R_E$ is determined to satisfy the following relationship for arbitrary values of $R_{70}/R_{20}$ and L $$1.44 - \frac{0.1}{\text{long}(R_{70}/R_{20}) - 0.20} \leqq \log(L \times R_E).$$

8. A PTC heating wire according to claim 7, wherein when a resistance of the electrode per unit length is taken as $R_E$ [ohm/m], a unit conduction path length of the PTC heating wire is taken as L [m] and a volume specific resistance of the PTC resistor under stable conditions is taken as $R_{PTC}$ [ohm·m], the value of $R_E$ is determined to satisfy the following relationship for arbitrary values of $R_{PTC}$ and L, $$R_E \times L^2/R_{PTC} \leqq 0.4.$$

9. A PTC heating wire according to claim 8, wherein when a resistance of the paired electrode per unit length is taken as $R_E$ [ohm/m], $R_E \leqq 1.0$ [ohm/m] is an applied voltage range of 100–120 [V] and $R_E \leqq 4.0$ [ohm/m] is an applied voltage range of 200–240 [V].

10. In a method for forming a PTC heater wire by providing a pair of electrodes, providing a PTC (positive temperature coefficient) resistor between the paired electrodes, and providing an insulative sheath about the paired electrodes and the resistor, the improvement comprising the steps of:

determining whether materials for said electrodes and said resistor satisfy a relationship $$1.44 - \frac{0.1}{\log(R_{70}/R_{20}) - 0.20} \leqq \log(L \times R_E)$$

wherein $R_E$ [ohm/m] represents a resistance per unit length of the material to be used for said electrodes, L [m] represents a unit conduction path length of the PCT heater wire, and $R_{70}/R_{20}$ represents a PCT characteristic of the material to be used for said resistor, in which $R_{70}$ represents a resistance of the resistor at 70° C. and $R_{20}$ represents a resistance of the resistor at 20° C., and selecting for said electrodes and said resistor only materials which satisfy said relationship.

11. The improved method of claim 10, comprising the further step of determining whether the materials to be used for said electrodes and said resistor satisfy a further relationship $$R_E \times L^2/R_{PTC} \leqq 0.4$$

wherein $R_{PTC}$ [ohm·m] represents a volume specific resistance under stable conditions of the material to be used for said resistor, and wherein said selecting step comprises selecting for said electrodes and said resistor only materials which satisfy both said relationship and said further relationship.

12. In a PTC heating wire which comprises a pair of electrodes, a PTC (positive temperature coefficient) resistor provided between the paired electrodes, and an insulative sheath provided about the paired electrodes and the resistor, the improvement wherein said electrodes comprise material having a predetermined resistance per unit length RE [ohm/m], said PTC heating wire is of a unit conduction path length, L [m], said PTC resistor comprises material having a predetermined PTC characteristic $R_{70}/R_{20}$ identifying a ratio of resistance of said resistor at 70° C. to resistance thereof at 20° C., and wherein the materials forming said electrodes and said resistor are interrelated in accordance with $$1.44 - \frac{0.1}{\log(R_{70}/R_{20}) - 0.20} \leqq \log(L \times R_E).$$

13. An improved PTC heating wire as recited in claim 12 wherein the materials forming said electrodes and said resistor are further interrelated in accordance with $$R_E \times L^2/R_{PTC} \leqq 0.4$$

wherein $R_{PTC}$ [ohm·m] represents a volume specific resistance of the PTC resistor under stable conditions.

* * * * *